United States Patent [19]

Podosek et al.

[11] Patent Number: 4,758,022

[45] Date of Patent: Jul. 19, 1988

[54] WRITING TABLET WITH TWO-PLY COVER

[75] Inventors: Edward Podosek, Wilbraham; Donn W. Meade, Chicopee, both of Mass.

[73] Assignee: Dennison National Company, Holyoke, Mass.

[21] Appl. No.: 894,794

[22] Filed: Aug. 8, 1986

[51] Int. Cl.[4] ..... B42C 11/02; B65D 37/00; B42D 7/00

[52] U.S. Cl. ..... 281/15 R; 229/1.5 R; 229/72; 281/15 B; 412/4

[58] Field of Search ..... 40/10 R, 12, 121, 359, 40/360; 206/311, 312, 232, 492; 229/68 R, 72, 1.5 R; 281/15 R, 15 A, 15 B, 29, 45, 34, 31, 35, 16, 17, 42; 412/4

[56] References Cited

U.S. PATENT DOCUMENTS

| | | | |
|---|---|---|---|
| 3,858,790 | 1/1975 | Humphrey | 229/72 |
| 3,870,223 | 3/1975 | Wyant | 229/72 |
| 4,051,996 | 10/1977 | Ross et al. | 229/72 |
| 4,301,962 | 11/1981 | Monckton et al. | 229/72 |
| 4,420,112 | 12/1983 | Cline | 229/72 |
| 4,610,392 | 9/1986 | DaRosa | 229/1.5 R |

FOREIGN PATENT DOCUMENTS

| | | | |
|---|---|---|---|
| 658862 | 10/1951 | United Kingdom | 281/15 B |

*Primary Examiner*—Paul A. Bell

*Attorney, Agent, or Firm*—Chapin, Neal & Dempsey

[57] ABSTRACT

A two-ply cover for a writing tablet is formed by a unitary die-cut blank of sheet material having an inner panel and an outer panel folded approximately along a medial fold line and sealed at their outer edges to form a pocket therebetween. The inner edge portions of the two cover panels are adhesively bonded to the back, upper edge portion of the tablet. The bonded edge portion of the outer panel corresponds to the width of the cover while the bonded edge portion of the inner panel consists of a tab substantially narrower than the cover. The tab and a fractional part of the outer panel's bonded edge portion are superposed with an adhesiver interface between the back of the writing tablet and the inner surface of the tab and the edge portions of the outer panel that are not coextensive with the tab.

4 Claims, 2 Drawing Sheets

WRITING TABLET WITH TWO-PLY COVER

BACKGROUND OF THE INVENTION

This invention relates generally to inexpensive covers for pads or tablets of writing paper and more particularly to an improved two-ply cover formed from a unitary blank of paper or light cardboard. The blank is folded approximately in half and then bonded to the upper back edge of the tablet so that a pocket is formed by the cover for the storage of loose papers and the like.

Writing tablets of the type in which a pad of writing sheets, perforated along one edge, are bound at their upper edges to a relatively stiff cardboard backing are well known in the art. The yellow legal pad is a typical example of this type of writing pad. The sheets of paper in these tablets are either removably attached to a plastic adhesive strip that extends perpendicularly from the cardboard backing, or to a short top section where the sheets are stapled to the backing above a tear line of perforations. In any case, such tablets are designed so that the writing sheets will either remain bound in the tablet or can be individually removed. The drawbacks of such pads are that the top sheet is exposed to view and unprotected and there is no provision for holding loose or extraneous sheets that the user may wish to retain.

In order to provide a storage pocket for a tablet of this type, the tablet is fitted into a binder or folder in which a pocket is included. Such folders or binders are adapted for continuous use by simply inserting a replacement pad when the former has been used up. U.S. Pat. No. 3,870,223 to Wyant shows an example of this type of folder formed from a single integral blank.

However, nowhere in the prior art is there suggested or disclosed a simple, inexpensive cover for a writing tablet that is permanently affixed to the tablet and includes a storage pocket. Accordingly, it is a principal object of this invention to provide such a pad and cover combination.

It is a further object of this invention to provide a writing tablet with a cover containing a pocket that is constructed from a single blank of material which is quickly and easily adhered to the tablet by means of a single strip of adhesive material.

It is another object of this invention to describe a process for quickly and inexpensively manufacturing and adhering a cover containing a pocket to a writing tablet.

The above and other objects and advantages of this invention will be more readily apparent from a reading of the following description taken together in conjunction with the accompying drawings in which.

DETAILED DESCRIPTION OF THE PREFERRED EMBODIMENT

Figure 1:
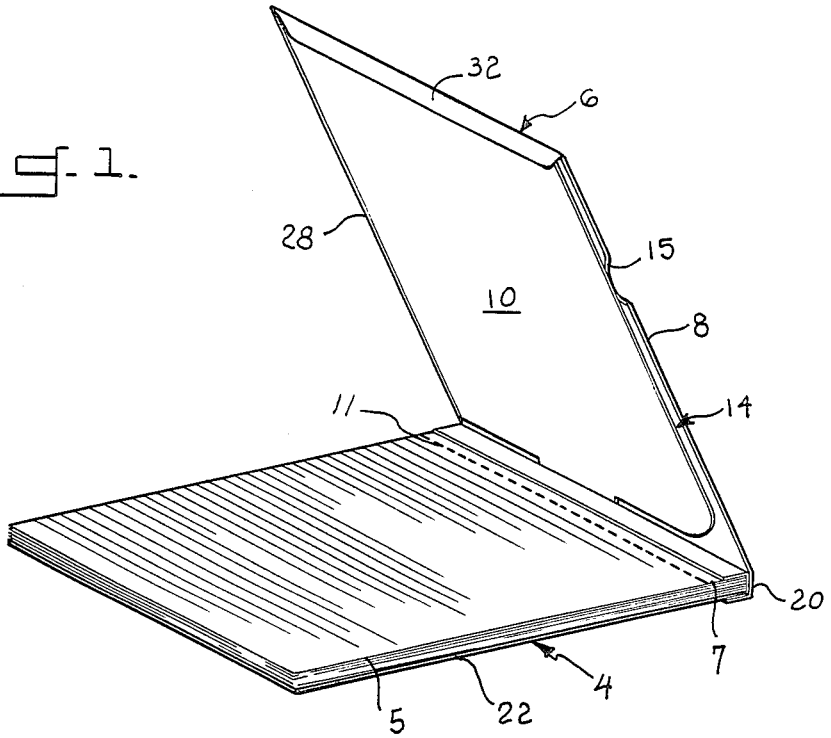
FIG. 1 is a perspective view of a writing tablet with cover which embodies this invention.

Referring to the drawings in detail, FIG. 1 shows the combination of a writing tablet or pad 4 and a two-ply cover 6 made in accordance with the present invention. The tablet contains a stack of removable sheets of paper 5 affixed to a relatively stiff cardboard backing 22 above a line of sheet perforations 11.

The cover 6 is generally constructed from a single die-cut blank 26 (FIG. 2) folded in such a way as to provide an outer panel 8 and an inner panel 10 that cooperate to form a pocket having an access opening 14 along one side edge of the cover. A concave notch 15 is provided along the edge of the pocket opening as an aid in opening the pocket for inserting materials between its two plies or panels 8 and 10. Fold line 28 defines the side edge of the cover opposite pocket opening 14 and the outer edge of the pocket and cover is formed by flap 32 which folds from the outer panel 8 and is sealed to the outer edge of the inner panel 10.

The inner edge of the cover 6 is affixed to the upper edge of the cardboard backing 22 of the tablet 4 by adhering the inner edge portion 20 of the outer panel and a relatively narrow tab 24 which extends from the center of the inner panel 10. Thus, the pocket is essentially closed or sealed on three sides, with the opening 14 on one side. It is significant that even though corresponding inner edge portions of the outer panel 8 and the inner panel 10 are bonded to the cardboard backing, these edge portions are not adhesively bonded to each other at this location. This is an advantage in both the fabrication of this product and in its operation.

Figure 2:
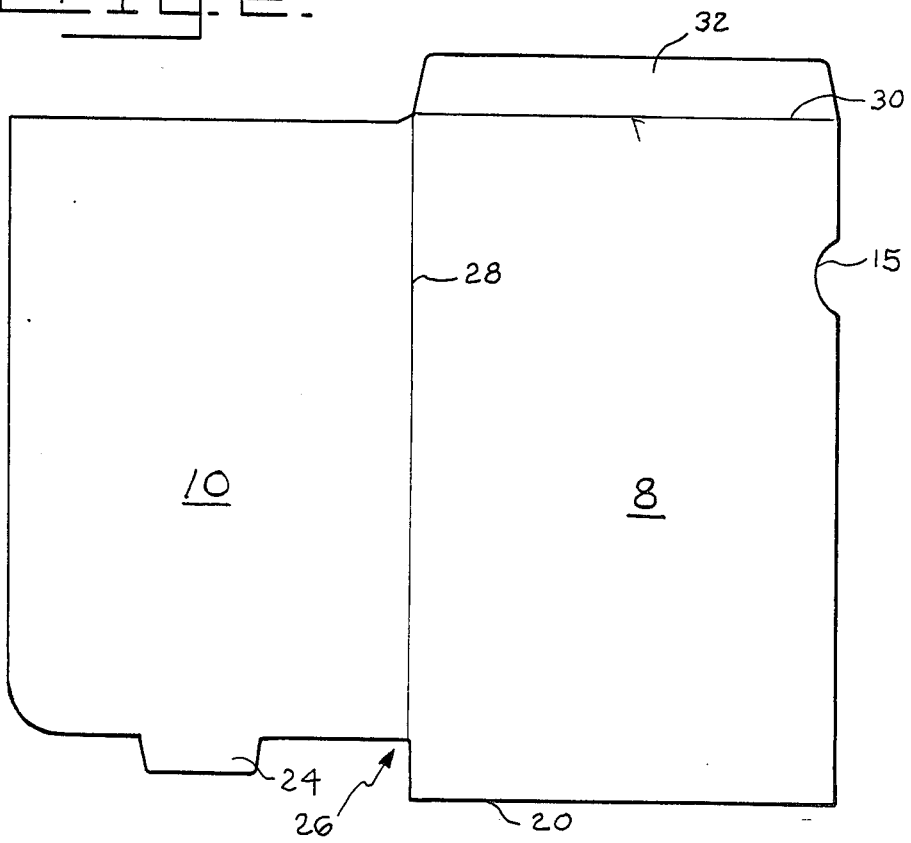
FIG. 2 is a plan view of a die-cut blank from which the cover is formed.

As seen in FIG. 2, the cover blank 26 is initially die-cut and creased or scored from a single sheet of material, preferably of a consistency of a heavy, kraft-type paper or a light cardboard. The cover blank 26 is especially cut to a configuration adapted to be folded and adhesively bonded into the desired cover configuration. The blank generally has a rectangular shape approximately bisected by a longitudinal extending crease or fold line 28.

Figure 3:
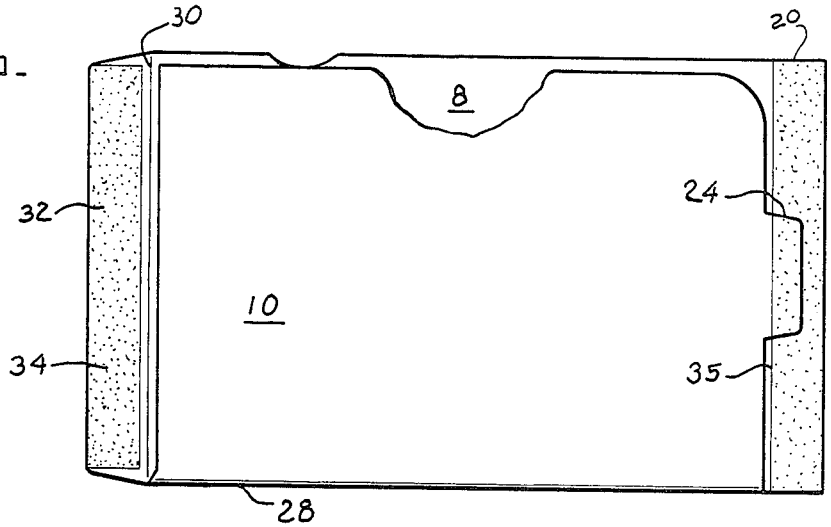
FIG. 3 is a plan view of the cover sheet after the initial fold and application of adhesive thereto.

As seen in FIG. 3, when the blank is folded along the crease 28, the blank comprises two superposed panels with the inner panel 10 being slightly smaller than the outer panel 8. The side edges of the inner and outer panels opposite the fold line 28 define the opening 14 of the pocket defined between the two panels.

Referring again to FIG. 2, across the upper end of the panel 8 is a crease or fold line 30 parallel to and an extension of the upper edge of the inner panel 10. A sealing flap or closure 32 extends from the crease line 30 and a strip of adhesive means or glue 34 (FIG. 3) is applied to this flap. After the blank 26 is initially folded along fold line 28, the flap 32 is folded on the crease or fold line 30 and glued to the bottom, outer side of the inner panel to seal one of the edges of the pocket 12 normal to the crease line.

As seen in FIG. 2, the narrow tab 24 extends outwardly from the lower edge of the inner panel 10. This tab is positioned approximately medially along the lower edge of the inner panel 10. Referring to FIG. 3, when the inner panel is folded onto the outer panel along the fold line 28, the tab 24 will be superimposed over the central portion of the lower edge portion 20 of the outer panel 10.

The height of the tab 24 is less than the height of the lower section 20 so that when a strip of glue 35 is applied to this area of the cover after the blank has been folded, the glue will be applied to the exposed surface of the tab 24 as well as the exposed corresponding edge portions of the outer panel 8. Thus, a single strip or band of glue 35 can be used to adhere the two-ply cover to the pad, and at the same time, closes the third side of the pocket.

Figure 4:
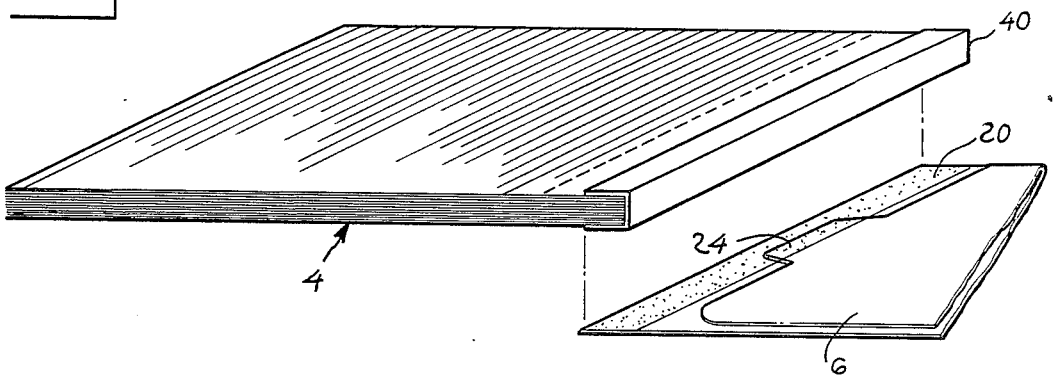
FIG. 4 is a perspective view of the tablet and a portion of the cover prior to the adhesive bonding thereof.
Figure 5:
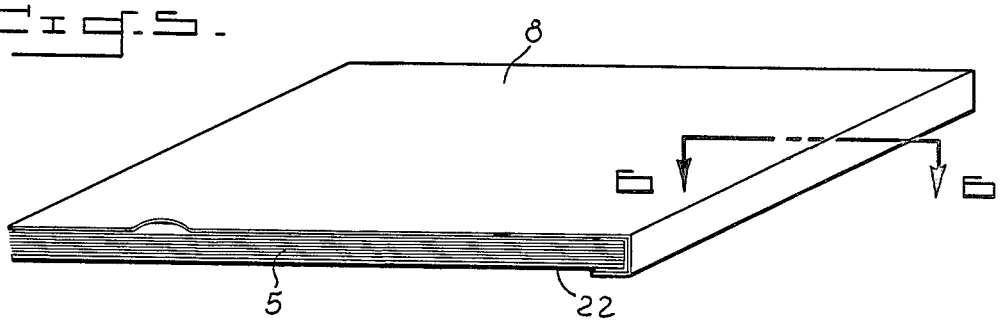
FIG. 5 is a perspective view of the completed tablet-cover combination.

To mount the cover to the pad, the inner edge portion of the cover is bonded to the upper edge portion of back panel 22, as shown in FIG. 4. The cover is then folded over the top edge of the pad so that it lies flat in edge-to-edge relation with the pad to provide a cover therefor. Because of the relatively narrow tab 24, the hinge portion of the cover which spans the upper edge of the pad 4, is predominantly a single ply construction except for the central portion thereof, where it is two-ply.

Figure 6:
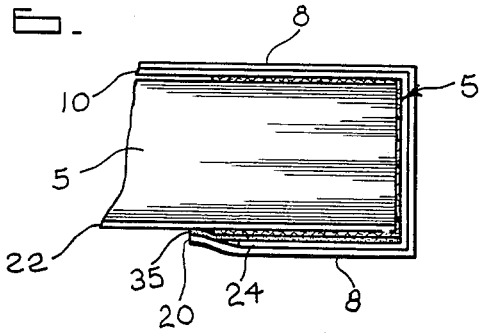
FIG. 6 is a section taken along lines 6—6 of FIG. 5 showing a portion of the tablet and cover, on an enlarged scale.

As shown in FIG. 6, there is only one layer of adhesive 35 bonding the cover 6 onto the tablet 4. The position and dimensions of the tab in cooperation with the lower edge portion of the outer provide for the sealing of the third edge of a pocket in the cover, even though there is no adhesive between the outer surface of the tab and the contacting surface of the outer panel. This construction eliminates the need to apply an adhesive layer or strip between the inner and outer panels at their edge portions which form the inner edge closure of the pocket. This arrangement also minimizes the amount of adhesive required to effect this edge closure attachment and, even though the amount of savings may appear to be small for one product when these savings are multiplied by millions of such pads, they become a significant factor in the manufacture of such items.

The process for manufacturing and installing covers, as described above, is initiated by die-cutting a blank of sheet material, as shown in FIG. 2, to a configuration adapted to be folded and adhesively bonded in the desired cover configuration. The blank is then folded about an approximately medially placed, laterally extending fold line with the outer panel 8 extending slightly outwardly of the inner panel 10, as shown in FIG. 3.

A strip of glue 34 is then applied onto the outer flaps 32 and 35 on the lower portion 20 and tab 24 superimposed thereon. The outer edge flap 32 of the panel 8 may then be folded onto the inner panel 10 and adhered thereto. The lower section and tab 24 are then bonded to the back panel 22 of the pad and the cover is folded over the top edge of the tablet to provide a pad cover and pocket. A two-ply cover containing a pocket for the convenient storage of loose items is thus inexpensively made and permanently attached to a writing tablet.

Having thus described my invention, what is claimed is:

1. Writing tablet in combination with hinged cover, said tablet having a relatively stiff backing member, a pad of paper sheets bound along one edge onto said backing member, sheets being individually separable from said tablet adjacent the upper edge thereof, the combination comprising a rectangular, unitary two-ply cover having an inner panel and outer panel defining a pocket therebetween, said pocket being closed on three sides and with an access opening to the pocket along the fourth side thereof, inner edge portions of the inner and outer panels of said cover being bonded to said pad along one edge thereof by the inner panel which has a narrow tab adhered to said pad and the outer panel has an edge portion adhered to said pad.

2. Writing tablet as set forth in claim 1 in which said tab is superimposed over a partial area of an edge portion of said outer panel, the remainder of said edge portion and the inner surface of said tab being adhesively bonded to the backing member of said pad, the outer surface of said tab and the inner surface of the outer panel having an essentially unbonded interface.

3. Writing tablet as set forth in claim 2 in which said tab extends medially from the lower edge of said inner panel and its outer edge is disposed inwardly of the corresponding edge portion of the outer panel, whereby a single band of adhesive applied along the lower edge of the outer panel and tab will coat the tab and the full length of the remainder of said lower edge portion, except for the area wherein the tab is superposed.

4. A method of forming a cover for a writing tablet of paper containing a pocket comprising the steps of die-cutting a unitary blank from a material, folding the blank approximately in the middle to form an inner and outer panel, the outer panel being slightly larger than the inner panel, and the inner panel having a tab extending for a short distance from its lower edge applying a band of adhesive onto said tab and the lower section of the outer panel disposed about said tab, bonding the adhesively coated tab and lower edge portion of the outer panel to said tablet.

* * * * *